United States Patent [19]

Kallen et al.

[11] Patent Number: 4,942,915

[45] Date of Patent: Jul. 24, 1990

[54] PROCESS FOR PRODUCTION OF A HOLLOW CASTING

[75] Inventors: Wilhelm Kallen; Ulrich Quack, both of Monchen-Gladbach, Fed. Rep. of Germany

[73] Assignee: Eisengiesserei Monforts GmbH & Co., Monchen-Gladbach, Fed. Rep. of Germany

[21] Appl. No.: 236,670

[22] Filed: Aug. 25, 1988

[30] Foreign Application Priority Data

Aug. 29, 1987 [DE] Fed. Rep. of Germany ..... 3728918

[51] Int. Cl.[5] ..... B22D 19/00

[52] U.S. Cl. ..... 164/34; 164/98

[58] Field of Search ..... 164/45, 98, 34–36, 164/245, 246, 249

[56] References Cited

U.S. PATENT DOCUMENTS

| | | | |
|---|---|---|---|
| 3,723,584 | 3/1973 | Nussbaum | 164/45 |
| 3,919,755 | 11/1975 | Kaneko | 164/98 |
| 4,148,352 | 4/1979 | Sensui et al. | 164/98 |
| 4,220,190 | 9/1980 | Horton et al. | 164/45 |
| 4,243,093 | 1/1981 | Nieman | 164/98 |
| 4,676,064 | 6/1987 | Narita et al. | 164/98 |
| 4,693,293 | 9/1987 | Yamamoto et al. | 164/98 |
| 4,712,605 | 12/1987 | Sasaki et al. | 164/98 |
| 4,809,762 | 3/1989 | Ito et al. | 164/34 |
| 4,849,266 | 7/1989 | Dwivedi et al. | 164/98 |

FOREIGN PATENT DOCUMENTS

| | | | |
|---|---|---|---|
| 1144882 | 7/1964 | Fed. Rep. of Germany . | |
| 1181373 | 11/1964 | Fed. Rep. of Germany . | |
| 1508655 | 10/1969 | Fed. Rep. of Germany . | |
| 2758993 | 7/1979 | Fed. Rep. of Germany . | |
| 151242 | 7/1987 | Japan | 164/45 |
| 1556468 | 11/1979 | United Kingdom | 164/98 |

*Primary Examiner*—Richard K. Seidel
*Assistant Examiner*—Edward A. Brown
*Attorney, Agent, or Firm*—Shefte, Pinckney & Sawyer

[57] ABSTRACT

A casting pattern and process for producing a hollow casting. The casting pattern has a foamed material body and can be constructed to prevent seams or fins from forming at points which are accessible only with difficulty, such as inside points. The contour of the foamed material body is covered on one side with a refractory mold part which is to be molded into the produced casting to form a corresponding part of the contour of the produced casting.

1 Claim, 2 Drawing Sheets

PROCESS FOR PRODUCTION OF A HOLLOW CASTING

BACKGROUND OF THE INVENTION

The present invention relates to a casting pattern having a foamed material body for producing a hollow casting in a metal foundry. The foamed material body consists of a material such as polystyrene particle foam or the like that transforms into a gas in response to the heat of liquid metal such as iron or aluminum. The invention also relates to a process for production of the casting pattern and a process for production of a hollow casting.

Plastic casting patterns consisting of polystyrene particle foam or similar material that transforms into a gas on contact with liquid metal are used in foundries. They are either embedded in binder-free molding material (and possibly subjected to a vacuum before and during casting) or they are molded in bonded molding material. Before insertion into the molds, the foamed material body made of polystyrene particle foam or the like is treated by immersion in, for example, an ordinary foundry blacking consisting of a slurry containing finely ground refractory material. In such a process, the surface of the shell consisting of blacking and facing the foamed material body forms the actual mold while the adjoining molding material such as, in particular, sand, serves only for mechanical support of the blacking shell, which is egg shell-fragile.

One problem with the blacking casting process is the production of the casting pattern itself. Production of a hollow pattern requires four mold shells; that is, two top-half molds and two bottom-half molds. The finished and hardened foamed material body thus consists of at least two shells, the boundary of which is unavoidably outlined on both the inner surface and the outer surface of the finished casting.

If the abutting faces of the shell parts of the foamed material body do not precisely fit together or are not precisely bonded together, blacking can penetrate between the faces. In this respect, problems arise with the use of parts which are difficult to access, particularly those on the inner side of a shell mold. Since the surface of the shell consisting of blacking and facing the foamed material body forms the actual mold of the casting to be produced, blacking projections which penetrate the foam body or seams between the parts thereof cause corresponding indentations in the casting. Such indentations spoil the castings.

A further problem with the blacking casting process is that the foam has a surface which is quite sensitive to pressure or impact forces. Since the abutting edges of foamed material body parts must remain as undamaged as possible, difficulties arise in the handling as well as the storage and transportation of these body parts. If a contact point is imprecisely machined or is damaged in transport or handling, it is generally possible to make repairs by inserting an adhesive piece which, like the foam, gasifies in the heat of the liquid metal. However, this repair process is expensive and often cannot be accomplished with the requisite accuracy, especially at inaccessible points on the inner side of a hollow pattern.

SUMMARY OF THE INVENTION

The present invention provides a hollow pattern made of foamed material that generally can be undercut at random and that has no fins or, at worst, has fins only at points (such as on the outside) where contact point refinishing can be carried out at an acceptable cost. This is achieved according to the present invention by a casting pattern for production of a hollow casting, the casting pattern having a foamed material body and the foamed material body having a contour covered on one side with a refractory mold part to be molded in the casting as a corresponding part of the casting's contour.

One advantage of the invention is that the surface of the foamed material body, which is not to be refinished if at all possible, is covered with a refractory mold part that directly defines a contour of the casting to be produced. As used herein, the "refractory mold part" may be of metallic or non-metallic material that can be directly molded into a metal casting and can form at least part of its outer surface. This includes metal mold parts made of sheet metal, cast iron, or forged material and even sintering material, ceramics, glass or similar materials. The mold part can be provided as an insert part on the inner surface of a hollow casting or as a shell part on the outer surface of a casting.

The invention thus allows the production of a composite element made of different metals, metals with different alloys or a metal and a non-metal material. For example, in accordance with the invention, a cast iron element having an inner contour formed by a prefabricated insert part made of sheet metal can be produced. Likewise, a composite element can be cast consisting of two metals having an outer shell made of iron and a hollow inner part made of aluminum. Among the many different kinds of castings that can be produced according to the present invention is a cast iron part coated with ceramics or glass on either the inside or the outside.

In another embodiment of the present invention, the foamed material body is molded without a seam on the refractory mold part. The foamed material body can typically be molded on the inner or outer surface of a hollow refractory mold part. The mold part thus forms a part of the shell of the shell mold for production of the foamed material body. A primary object in this process is the production of a one-part foamed material body without the seams which can lead to defects or require refinishing.

If the refractory mold part is to form an insert of the foamed material body (which itself is to be inserted into the casting), production of the complete foam pattern requires only a single mold with bottom and top shells corresponding to the intended outer contour of the foamed material body since an insert part defining the inner surface of the casting is used as the core of the mold. Likewise, if the outer shell of the foamed material body is to be covered with the refractory mold part, production of the complete foam pattern requires only a single mold.

If the hollow foamed material body of the present invention is to be produced in one part, no undesired indentations will result because the blacking which is applied to the foamed material body cannot penetrate the body since there are no seams. In the hollow foamed material body used according to the present invention, only outwardly projecting fins can form on the foam in the boundary between top and bottom shells of the outer mold used to produce the foamed material body but these outwardly projecting fins can be removed without any difficulty.

According to the present invention, the contoured surface of the foamed material body which faces the casting may, if desired, be covered with an insulating material such as mineral wool. This arrangement is particularly advantageous for casting that are intended to be subjected to heat in use. The intermediate layer of insulating material is also advantageous for structural parts such as exhaust manifolds which are designed to absorb a minimum amount of heat so that downstream components (that is, in the stream of waste gas), such as catalytic converters, will heat up as rapidly as possible. The provision of a jacket of insulating material also makes it possible to reduce the weight of the casting without diminishing its volume. In any event, the insulating jacket can be provided not only on the inner or outer surface but also at the boundary of the different layers of a composite element formed according to the present invention. The use of the refractory mold part of the present invention is thus advantageous if one surface of a casting is to have a certain alloy to insure necessary chemical resistance, as might occur in a chemical environment.

In yet another embodiment of the present invention, a process is provided for production of a hollow casting in a metal foundry using a foamed material body of polystyrene particle foam or the like that transforms into a gas in response to the heat of liquid metal (such as iron or aluminum), with the foamed material body being covered on one side during casting with a refractory mold part defining the contour of the casting. This process allows a substantial part of the inner or outer contour of the casting to be prefabricated and thus molded as a prefabricated part into the finished casting.

Further features and advantages of the present invention will be apparent from the accompanying drawings and following detailed description of the preferred embodiments.

DETAILED DESCRIPTION OF THE PREFERRED EMBODIMENTS

Figure 1:
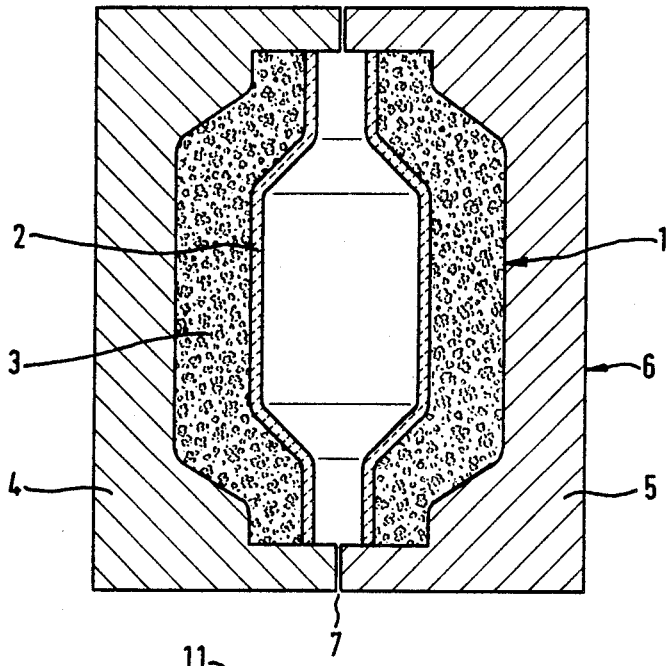
FIG. 1 is a vertical sectional view of a mold for production of a hollow foamed material body according to the present invention.

In FIG. 1, a prepared mold for production of a casting pattern 1 according to the present invention is illustrated. Pattern 1 consists of a refractory mold part 2 and a one-piece foamed material body 3 formed thereon. In addition to the mold part 2, which serves as an inner shell, an outer shell 6 consisting of a top-half mold 4 and a bottom-half mold 5 is provided to mold the foamed material body 3.

No inaccessible seam can form on the inner surface during production of the casting pattern 1 because the inner contour is already defined by the inner surface of the mold part 2. At worst, an outwardly projecting fin may form on the outer surface of the foamed material body 3 at the abutting faces 7 between the top-half mold 4 and the bottom-half mold 5 when the two half molds are not in precise alignment at the abutting faces 7. However, this kind of fin can easily be machined from the finished casting. In no case is there an unwanted inward bend or indentation in the contour of the casting pattern 1 which could disadvantageously fill with blacking during further processing of the casting.

Figure 2:
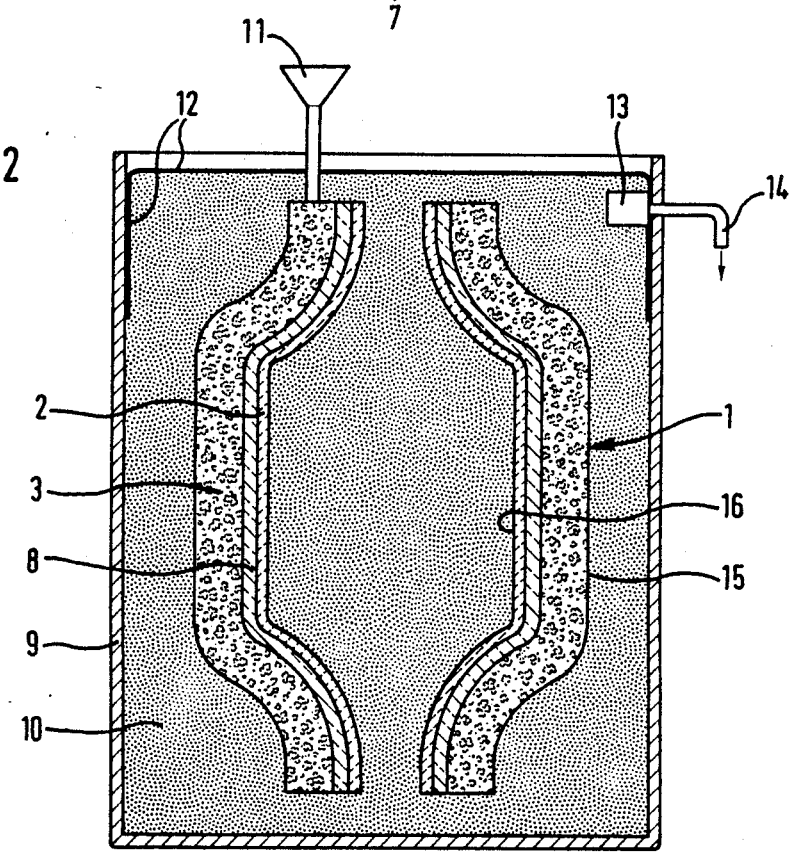
FIG. 2 is a vertical sectional view of an iron foundry mold provided with a hollow foamed material body formed in the mold shown in FIG. 1.

FIG. 2 illustrates a mold prepared for an iron foundry with the casting pattern 1 of FIG. 1 positioned within the mold. The casting pattern 1 comprises a layer 8 of insulating material intermediate the mold part 2 and the foamed material body 3. The casting pattern 1 is embedded in binder-free molding material 10 (which is preferably sand) within mold box 9 of the iron foundry mold in such a manner that no unfilled cavity remains in the mold box 9. For example, casting pattern 1 can be embedded by a jarring process to insure that no cavity remains in the mold box 9. A funnel 11 is mounted on one end of the foamed material body 3. The entire surface of the molding material 10 is surrounded with an air-tight foil 12 such that a vacuum pump having an exhaust connection piece 13 and a vacuum pipe 14 can evacuate sufficient air from the mold box 9 and molding material 10 that the molding material 10 becomes stiff.

When liquid iron is poured into the funnel 11, the material of the foamed material body 3 transforms into a gas and passes through the vacuum pipe 14 to the extent that the foamed material is replaced by the liquid iron. In this casting process, the refractory mold part 2 (and, if desired, the insulating material layer 8) becomes a part of the produced casting. The casting thus ultimately takes up the space originally filled by the foamed material body 3. The contour of the foamed material body 3, which is the outer contour 15 in the illustrated embodiment, thus becomes the outer contour of the produced casting. The inner contour 16 of the casting pattern 1, which is the inner surface of the mold part 2 in the illustrated embodiment, forms the inner contour of the produced casting.

Figure 3:
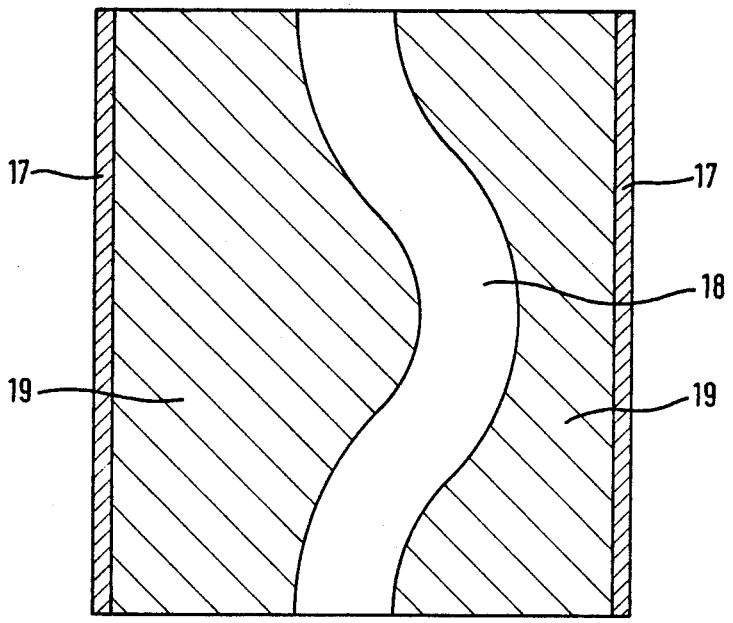
FIG. 3 is a vertical sectional view of another mold having a casting pattern according to the present invention.

In FIG. 3, another embodiment of the present invention is illustrated. A composite casting includes an iron layer 17 forming its outer contour and a hollow aluminum body 19 having an inner passage 18. During molding, the aluminum body 19 replaces a foamed material body which is provided within the iron layer 17. The foamed material body includes a passage which becomes the inner passage 18. During the casting process, the passage of the foamed material body can be filled, for example, with a removable material so that, upon replacement of the foamed material body by the aluminum of the aluminum body 19 during the casting process, the passage 18 is formed.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A process for producing a hollow metal casting, comprising the steps of:

providing a casting pattern having a foamed material body with a surface, said providing a casting pattern including forming said foamed material body in a shell mold having two halves, and an inner part having a refractory mold part covering said surface of said foamed material body; and introducing a liquid metal onto said casting pattern to replace said foamed material body as said body transforms into a gas, whereby a hollow metal casting incorporating said refractory mold part is formed.

* * * * *